United States Patent [19]

Terui

[11] 4,329,810

[45] May 18, 1982

[54] COIN WEIGHTED TOY RACING CAR

[75] Inventor: Masumi Terui, Matsudoshi, Japan

[73] Assignee: Takara Co., Ltd., Tokyo, Japan

[21] Appl. No.: 205,990

[22] Filed: Nov. 12, 1980

[30] Foreign Application Priority Data

Nov. 27, 1979 [JP] Japan ..... 54-164128

[51] Int. Cl.[3] ..... A63H 17/00

[52] U.S. Cl. ..... 46/206; 46/202

[58] Field of Search ..... 46/206, 201, 211, 251, 46/252, 253, 254, 255, 256, 202

[56] References Cited

U.S. PATENT DOCUMENTS

| | | | |
|---|---|---|---|
| 1,682,764 | 9/1928 | Mohr | 46/211 X |
| 3,720,019 | 3/1973 | Waznys et al. | 46/253 |
| 3,803,756 | 4/1974 | Strongin | 46/202 |
| 3,822,880 | 7/1974 | Terzian et al. | 46/251 X |
| 4,183,174 | 1/1980 | Barris et al. | 46/254 |

*Primary Examiner*—Gene Mancene
*Assistant Examiner*—Mickey Yu
*Attorney, Agent, or Firm*—Jackson, Jones & Price

[57] ABSTRACT

A toy racing car is provided having a configuration to simulate a racing car such as a drag car. A support member is attached to the body of the car at a predetermined location to receive a weighted member such as a coin of monetary value. The addition of the coin alters the location of the total center of gravity of the car and positions it so that upon the application of a small additional force, the front wheels will be lifted off the ground to provide an impression of high speed acceleration.

10 Claims, 6 Drawing Figures

FIG. 1
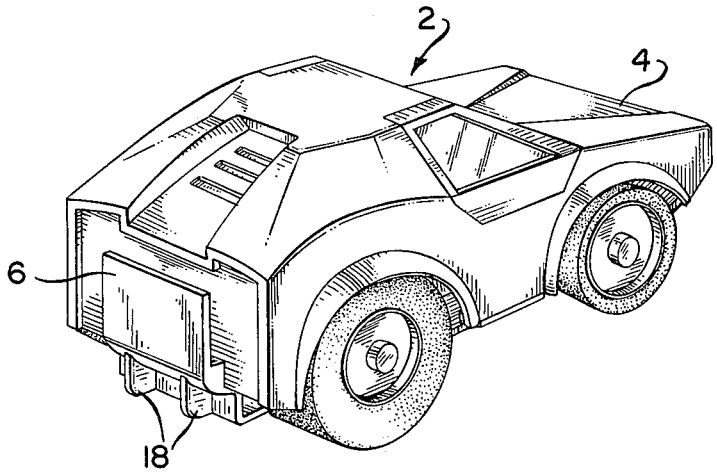
FIG. 2
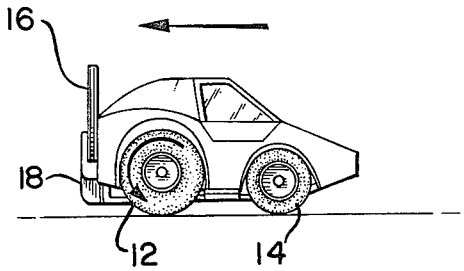
FIG. 3
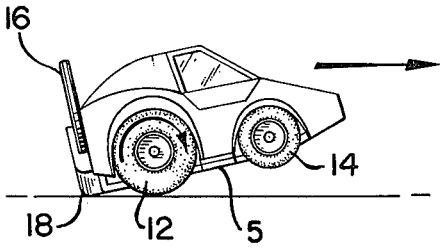
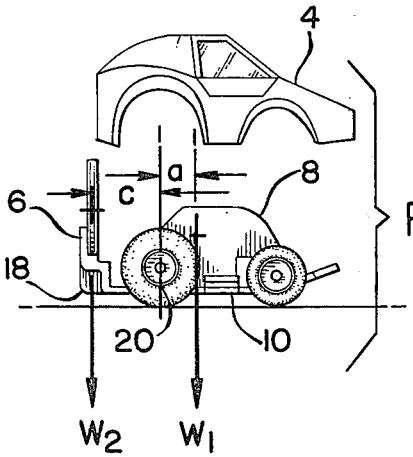
FIG. 4
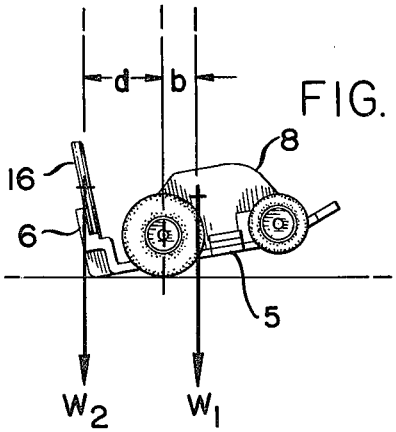
FIG. 5
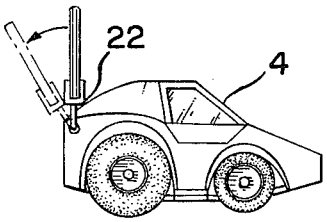
FIG. 6

COIN WEIGHTED TOY RACING CAR

BACKGROUND OF THE INVENTION

1. Field of the Invention

A toy racing car is provided with a specifically positioned support member on the body of the racing car to receive and removably support a monetary coin of a predetermined weight. The toy car, when propelled forward, provides an impression of high speed acceleration with its front wheel assembly being lifted off the ground as a result of the location and weight of the coin.

2. Description of the Prior Art

Numerous forms of toy cars that are self-propelled have been provided by the toy industry. Simulated racing cars and drag cars have been a frequent subject of toy designs. Generally, a common design approach has been to simulate as closely as possible the configuration and appearance of a toy racing car to capture the imagination of a child. Very seldom has a toy been presented to the child that requires an integration of an extemporaneous common object to complete the structural functioning of the toy vehicle.

The toy industry demands a continued infusion of new toy concepts and is accordingly still receptive to new and novel toy racing car designs to entertain and elicit the interest of children.

SUMMARY OF THE INVENTION

The present invention provides a toy racing car that includes a housing member having a configuration which simulates a vehicle. Front and rear wheel assemblies are operatively attached to the housing member. The housing member can include a upper body shell and a lower frame member. A vertically upward extending support bracket from the lower frame member provides a cavity or slot with the rear vertical surface of the body shell. The distance between the body shell and the bracket is approximately the width of a monetary coin such as a penny or a nickel. With the inclusion of a coin into the cavity, the child creates a vehicle whose combined center of gravity is approximately over the rear wheel assembly. A relatively small additional force that can be applied to the car will rotate the center of gravity to the rear of the rear wheel assembly and will lift the front wheels off the ground. The toy car can be propelled by a spring-wound motor mounted on the frame to provide the additional force component and create an impression of speed with the front wheels lifted off the support surface. The specific design of the present invention which incorporates a monetary coin as an operative weighted member of the racing car provides a novel concept to capture the imagination and interest of children.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 is a perspective view of a miniature toy racing car;

FIG. 2 is a side perspective view of the toy racing car with a monetary coin in a mode of operation to wind up the spring motor;

FIG. 3 discloses the toy racing car traveling in a forward direction;

FIG. 4 is a partial side exploded view of the present invention;

FIG. 5 is a schematic side view disclosing the force vectors on the car, and FIG. 6 is a schematic side view disclosing an alternative embodiment of the present invention.

DETAILED DESCRIPTION OF THE PREFERRED EMBODIMENTS

The following description is provided to enable any person skilled in the toy industry to make and use the present invention and sets forth the best modes contemplated by the inventor for carrying out his invention. Various modifications, however, will remain readily apparent to those skilled in the art, since the generic principles of the present invention have been defined herein specifically to provide a novel toy racing car that can be combined with a monetary coin.

The primary purpose of the present invention is to provide a new and unique toy car structure that can be operatively combined with a monetary coin such as a penny or a nickel to provide a novel mode of operation. The availability of monetary coins and a child's natural fascination with money enhances the play value and interest of the child in the toy. While the toy car is designed to be self-propelled, preferably with a relatively inexpensive spring-wound motor, and it is capable of normal operation without the inclusion of the monetary coin as a weighted member, it has been particularly designed to incorporate the weight of a coin in a specific position along the car body to create an impression of speed which has lifted the front wheels of the car off of a support surface.

Referring to FIG. 1, a perspective view of a toy racing car 2 is disclosed. The body or shell 4 of the vehicle housing can be provided of any subjective configuration and is preferably molded of plastic. A supporting member or bracket 6 extends vertically upward adjacent the rear surface of the body 4 to receive and removably hold the weighted member such as a coin of monetary value, e.g., a penny or nickel. A spring-wound motor assembly 8 as can be seen in FIG. 4 is mounted on a one-piece frame 10 that can also integrally provide the support bracket 6.

As can be readily appreciated, other forms of propulsion can be utilized, but a spring motor assembly that is appropriately geared with a one-way clutching mechanism can provide an efficient and relatively inexpensive prime mover. The housing member 2 includes a lower frame member 5 and the housing shell 4, the lower frame member 5 has a substantially L-shaped cross sectional configuration, as seen in FIGS. 4 and 5, and includes the vertical bracket 6 which extends upward adjacent the vertical rear surface of the housing shell 4 for a distance substantially less than the diameter of the monetary coin. The bracket 6 is also positioned a distance from the shell 4 of approximately the width of a monetary coin to provide a frictional connection for supporting the coin in a vertical position across the rear surface of the housing shell 4 as seen in FIG. 2.

Referring to FIG. 2, the car can be pushed rearward to provide a counter-clockwise rotation to the rear wheel assembly 12 to wind the spring motor assembly 8.

A one-way clutch mechanism (not shown) can release a portion of the gear drive to provide a better gear ratio for forward propulsion as is well known in the toy industry.

A monetary coin, such as a penny 16, can be removably mounted within the support bracket 6 which provides a slotted compartment extending parallel to the rear axle. When the racing car 2 is released, as shown in FIG. 3, the front wheel assembly 14 is lifted off the support surface so that a guide member or portion 18 which forms a curvilinear surface at the bottom of the bracket 6 contacts the support surface to slide therealong.

Referring to FIGS. 4 and 5, the toy racing car structure has been designed specifically so that the combined weight of the monetary coin 16 and the toy racing car 2 will place the center of gravity above or slightly forward of the rear axle 20. As can be seen in FIG. 5, the rotation of the front of the toy car upward to permit the guide member 18 to contact the support surface is sufficient to alter the position of the combined center of gravity so that it is rearward of the vertical plane of the rear axle 20. The force vectors $W_1$ in FIG. 4 schematically disclose the weight force vector of the toy racing car without the added weighted member of a monetary coin. This force vector is at a distance, a, from the pivot point between the rear wheel tire and the support surface. The weight force vector of the coin $W_2$ is at a distance c from this pivot point.

In FIG. 5, the rotation of the toy car has displaced the force vector of the weighted coin so that it now has a greater moment arm represented by the distance d while the moment arm of the car weight force vector $W_1$ is reduced to the distance b. Quite simply, the product of d times $W_2$ is greater than the product of b times $W_1$. The difference in force ($dW_2$-$bW_1$) is balanced by the guide member when it presses against the support surface to keep the toy car in a state of equilibrium.

The inertia force that is generated when the car is initially released to be driven by the spring motor assembly 8 is sufficient to offset any initial equilibrium or force balance that maintained the front wheels against the support surface. When the car is rotated upward, the resultant alteration in the length of the moment arms is sufficient to maintain the car so that it will slide along the guide member 18 with the front wheels 14 elevated. The resulting impression that is created for the child is that the torque speed generated by the motor of the car was sufficient to lift the front wheel assembly off the ground in a manner that is frequently seen in drag races.

As can be readily appreciated, the car design can be altered to accommodate the weight of any specific coin or other forms of weighted members. The important design guideline is that the car without the coin is still stable and is propelled with all four wheels on the support surface, and when the coin is added it becomes balanced about the rear wheel so that only a slight propulsion force is sufficient to elevate the front wheels and make the car assume the appearance of being subjected to excessive speed.

Referring to FIG. 6, an alternative embodiment of the present invention is disclosed wherein a pivotable support member 22 is connected to the body 4 by a friction fit that permits a subjective positioning of the support member 22 relative to the rear surface of the vehicle. By virtue of this arrangement, variations in the weight of different coins can be compensated by a relative positioning of the pivotable support member 22. The bottom rear surface of the toy car can be dimensioned relative to the position of the rear wheels to serve the function of a guide member as described earlier.

Persons skilled in the toy field would be capable of modifying the various embodiments of the present invention within its generic teachings.

Accordingly, the scope of the present invention should be measured solely from the following claims, wherein I claim:

1. A combination toy car and monetary coin comprising:

a monetary coin;

a housing member having a configuration which simulates a vehicle;

a front wheel assembly attached to the housing member;

a rear wheel assembly including an axle and a pair of wheels attached to the housing member;

a support member attached to the housing member on the side of the rear wheel assembly furtherest from the front wheel assembly, the support member configured to provide an exterior slotted compartment extending parallel to the rear axle, the width of the slot being approximately that of the monetary coin to provide a removable frictional connection, the monetary coin removably mounted in the slotted opening and extending upward adjacent the rear surface of the housing member for visible display, the support member is positioned on the housing member a predetermined distance from the rear axle so that the center of gravity of the car without a coin is forward of the rear axle and with a coin is approximately above the rear axle, and a guide member configured to contact and slide on a support surface when the front wheel assembly is lifted off the support surface, the guide member is positioned to support the vehicle when rotated about the rear axle so that the weight of the car and the coin, as displaced by acceleration of the car, is partially supported by the guide member, and the equilibrium position of all force vectors is rearward of the rear axle whereby the toy car can be propelled forward to provide an impression of speed which has lifted the front wheel assembly off the ground.

2. The invention of claim 1 wherein the support member is pivotably mounted to permit a subjective positioning relative to the housing member whereby variations in the weight of different coins can be compensated by the relative position of the pivotable support member.

3. The invention of claim 1 wherein the housing member includes removable housing shell and a lower frame member, the lower frame member having substantially an L-shaped cross sectional configuration, wherein the lower frame member includes an approximately vertical bracket extending rearward and adjacent the vertical rear surface of the housing shell to form the support member and provide a vertical positioning of the coin across the rear surface of the housing shell.

4. The invention of claim 3 further including a self-contained motor assembly mounted only on the lower frame member and operatively connected to the rear wheel assembly whereby various configurations of housing shells can be provided on a common lower frame member.

5. The invention of claim 4 wherein the self-contained motor assembly is spring powered.

6. The invention of claim 5 wherein the monetary coin is a United States penny.

7. A toy car assembly comprising:

a monetary coin;

a housing member having a configuration which simulates a vehicle, including a lower frame member and a housing shell, the lower frame member includes an approximately vertical bracket extending rearward and upward adjacent the vertical rear surface of the housing shell at a sufficient distance to provide a frictional fit of the monetary coin between the housing shell rear surface and the vertical bracket;

a front wheel assembly attached to the housing member;

a rear wheel assembly including an axle and a pair of wheels attached to the housing member;

a self-contained motor assembly attached to the housing member to drive the toy car, the rear vertical bracket is positioned on the housing member a predetermined distance from the rear axle so that the center of gravity of the car without the coin mounted in the bracket is forward of the rear axle and with a coin is approximately above the rear axle, and a guide member configured to contact and slide on a support surface when the front wheel assembly is lifted off the support surface, the guide member is positioned to support the vehicle when rotated about the rear axle so that the equilibrium of forces on the car and the coin as rotated during acceleration is partially supported by the guide member and is positioned rearward of the rear axle whereby the toy car can be propelled forward to provide an impression of speed which has lifted the front wheel assembly off the ground.

8. The invention of claim 7 wherein the monetary coin is a United States Penny.

9. The invention of claim 8 wherein the vertical bracket has a height substantially less than the diameter of the penny, whereby the penny is visually displayed as a major portion of the rear view of the toy car.

10. The invention of claim 9 wherein the self-contained motor assembly is spring powered.

* * * * *